United States Patent [19]

Kobayashi

[11] Patent Number: 4,930,170

[45] Date of Patent: Jun. 5, 1990

[54] FOLDABLE AND TRANSFORMABLE THICK MAT

[75] Inventor: Kouichi Kobayashi, Fukui, Japan

[73] Assignee: Maruichi Selling Kabushiki Kaisha, Imadate, Japan

[21] Appl. No.: 118,466

[22] Filed: Nov. 9, 1987

[30] Foreign Application Priority Data

May 22, 1987 [JP] Japan ..... 62-126722

[51] Int. Cl.[5] ..... A47C 17/04; A47C 27/22

[52] U.S. Cl. ..... 5/12 R; 5/465; 5/481; 5/462; 5/470; 5/420

[58] Field of Search ..... 297/455, 456, DIG. 1, 297/109, 337, 328; 5/12 R, 420, 465, 474, 481, 477, 462, 437, 470, 461, 468

[56] References Cited

U.S. PATENT DOCUMENTS

| | | | |
|---|---|---|---|
| 681,573 | 8/1901 | Nichols | 5/468 |
| 1,381,134 | 6/1921 | Ostafijlnuk | 5/465 |
| 1,418,501 | 6/1922 | Weinshenk | 5/465 X |
| 1,423,954 | 7/1922 | Maussner | 5/465 |
| 1,457,203 | 5/1923 | Wick | 5/465 |
| 1,785,252 | 12/1930 | Frank | 5/465 |
| 1,892,679 | 1/1933 | Penner | 5/465 |
| 1,955,040 | 4/1934 | Wittloff | 297/382 |
| 2,589,579 | 3/1952 | Slayen | 5/465 |
| 3,242,511 | 3/1966 | Fultz et al. | 5/468 |
| 3,273,180 | 9/1966 | Feinerman | 5/481 |
| 3,293,671 | 12/1966 | Griffin | 5/481 X |
| 3,305,878 | 2/1967 | Hellbaum | 5/437 X |
| 3,319,273 | 5/1967 | Solin | 5/465 |
| 3,428,974 | 2/1969 | Stuart | 5/465 X |
| 3,602,548 | 8/1971 | Grams | 5/437 X |
| 3,761,131 | 9/1973 | Oliver | 5/465 |
| 3,808,616 | 5/1974 | White | 5/465 |
| 4,116,148 | 9/1978 | Torrez | 297/455 |
| 4,365,371 | 12/1982 | Boussaroque | 5/462 |
| 4,518,203 | 5/1985 | White | 297/456 |
| 4,523,344 | 6/1985 | Stumpf et al. | 5/465 X |

FOREIGN PATENT DOCUMENTS

| | | | |
|---|---|---|---|
| 15302 | of 1929 | Australia | 5/365 |
| 203655 | 5/1959 | Fed. Rep. of Germany | 5/12 R |
| 536561 | 5/1922 | France | 5/12 R |
| 754879 | 9/1933 | France | 5/470 |
| 785687 | 5/1935 | France | 5/437 |
| 641452 | 8/1962 | Italy | 5/465 |
| 52674 | 3/1911 | Switzerland | 5/470 |
| 161006 | 6/1933 | Switzerland | 5/470 |
| 985155 | 3/1965 | United Kingdom | 5/465 |

*Primary Examiner*—Eric K. Nicholson
*Attorney, Agent, or Firm*—Staas & Halsey

[57] ABSTRACT

A mat comprising a cushion base having a plurality of block plates each having cushion property and foldably connected together. A cushion member covers the upper surface of the cushion base, and the cushion base and the cushion member are detachably connected. The block plates are connected together at adjacent upper surfaces thereof and movably foldable about a centrally disposed fold line and a plurality of parallel transverse fold lines intersecting the longitudinal fold line. The fold lines are formed by slots which facilitate separation of the sehments when folded.

4 Claims, 5 Drawing Sheets

FOLDABLE AND TRANSFORMABLE THICK MAT

BACKGROUND OF THE INVENTION

1. Field of Invention

The present invention relates to a thick mat which is foldable and transformable and is capable of holding the folded condition, and more particularly, to a mat which comprises a thick cushion base including a plurality of block plates connected together, and a cushion member connected to the cushion base and having a longitudinal fold line and a plurality of intersecting lateral fold lines formed at the connection between the block plates, along which fold lines the cushion member is foldable so that the mat can be transformed into a desired shape for use as lounge, sofa, bed, etc.

2. Description of the Related Art

The conventional thick mat has some flexibility and seems to be usable in a bent condition. Actually, however, this mat tends to return to its original, flat condition when load or other bending stress is removed, and therefore, this mat lacks shape-keeping stability and is not applicable to various purposes. Thus, separate attachments for supporting arms, back, legs are necessary for this conventional flat mat.

Use of such attachments is inadvantageous to users because they are so bulky that it is inconvenient to keep them in a room having a limited space. Further, it requires storage space and stock management and thus it further costs manufactures and distributors inadvantageously.

SUMMARY OF THE INVENTION

Accordingly, an object of the present invention is to provide a mat of a predetermined thickness which is foldable and transformable into a desired shape and utilizes a wall as a support to maintain its transformation so that it is applicable for various purposes, without using attachments.

Another object of the present invention is to provide a mat having a cushion base and a cushion member easily detachable from each other so as to facilitate exchange or cleaning of the damaged or soiled cushion base and cushion member.

A further object of the present invention is to provide a mat which improves stability in use by inserting core material in the cushion member along the longitudinal, side edges thereof.

Yet another object of the present invention is to provide a mat which allows the cushion member to easily follow the bend of the cushion base, by forming the cushion member with fold lines in alignment with a longitudinal fold line and a plurality of lateral fold lines of the cushion base.

Another object of the present invention is to provide a mat which improves comfort by providing the cushion base with air permeability.

In a preferred embodiment, relates to a foldable and transformable thick mat includes a cushion base having a plurality of block plates with cushion property and foldably connected together, a cushion member covering the upper surface of the cushion base, and connection means for detachably connecting the cushion base and the cushion member.

The cushion base and the cushion member are each provided with a fold line extending almost in the center thereof and a plurality of parallel fold lines intersecting said fold line, thereby allowing them to be folded along the fold lines. Other objects and advantages of the present invention will be apparent from the following description.

DETAILED DESCRIPTION OF THE PREFERRED EMBODIMENTS

Figure 1:
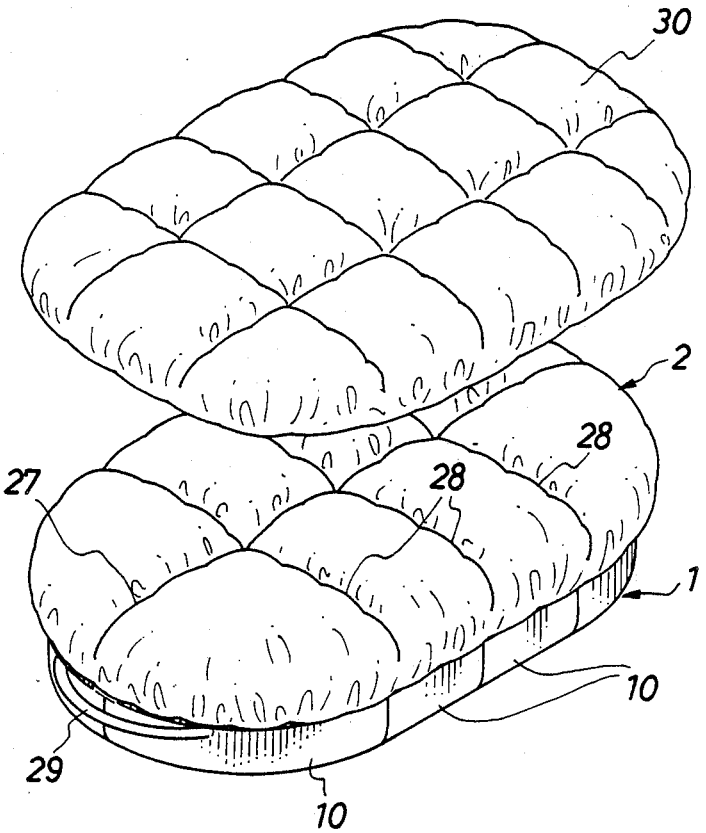
FIG. 1 is a perspective view of a mat according to the present invention showing an optional, additional cushion.
Figure 2:
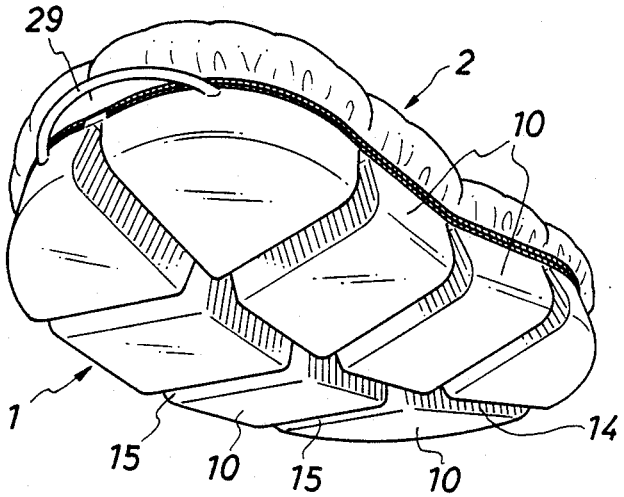
FIG. 2 is a perspective view of the folded and transformed mat as seen from the bottom.
Figure 3:
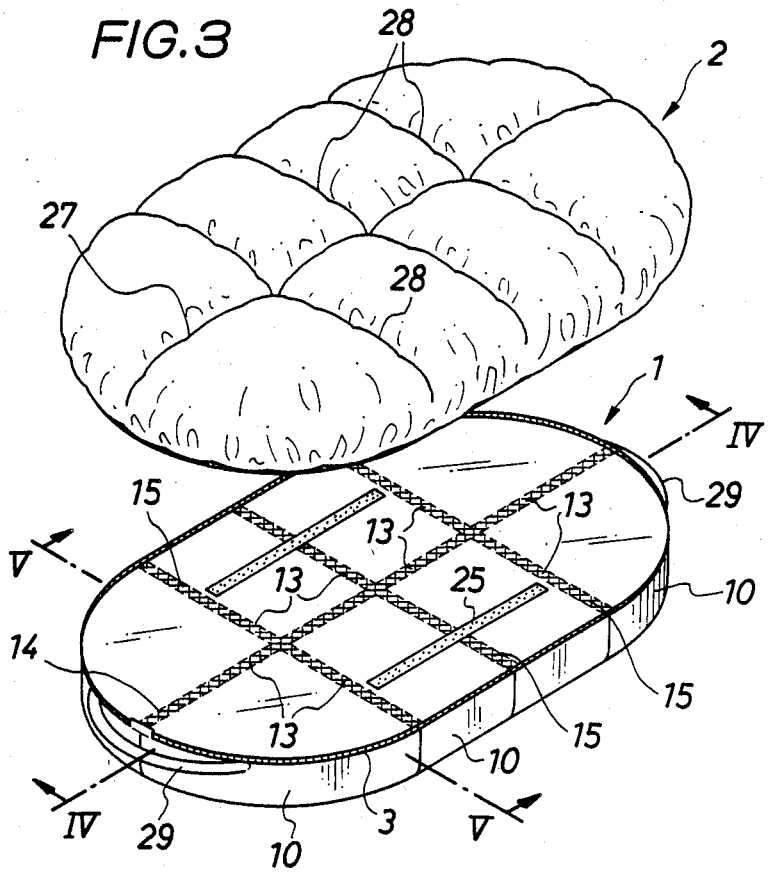
FIG. 3 is an exploded perspective view of the mat.
Figure 4:
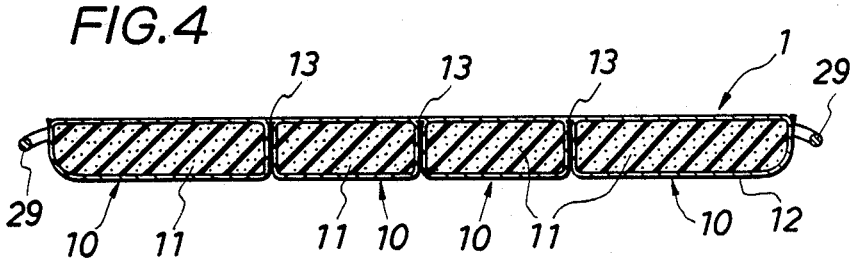
FIG. 4 is a sectional view taken on the line of IV—IV of FIG. 3.
Figure 5:
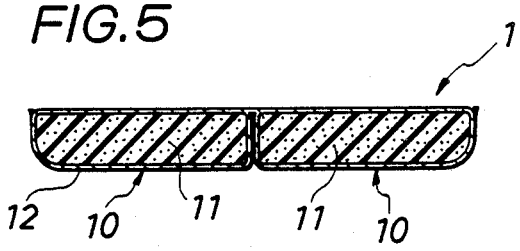
FIG. 5 is a sectional view taken on the line of V—V of FIG. 3.
Figure 6:
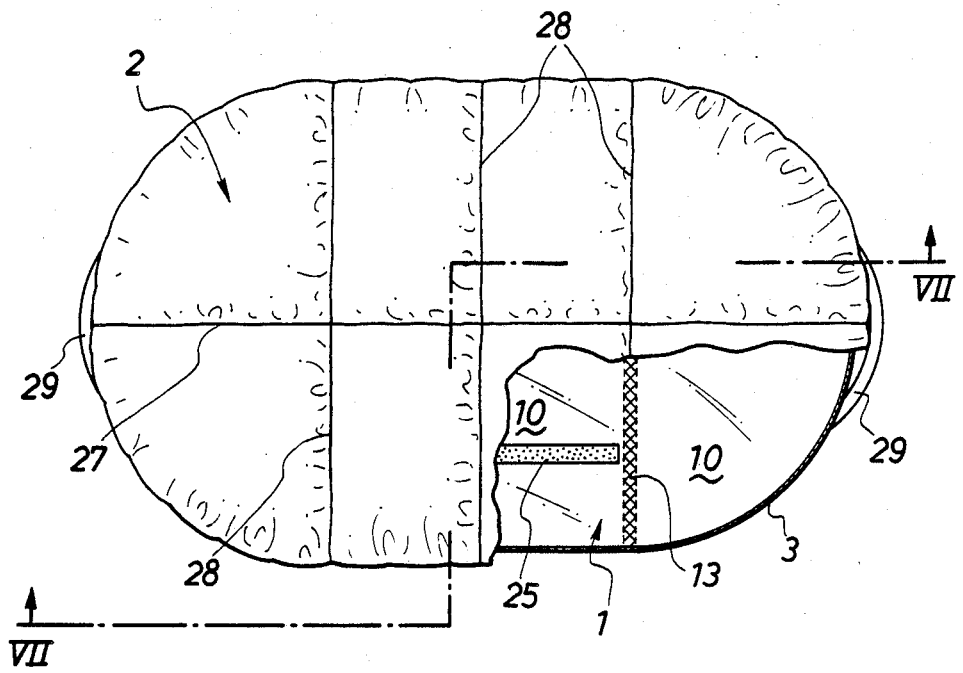
FIG. 6 is a top plan view with the cushion member partially cut away to show the cushion base.
Figure 7:
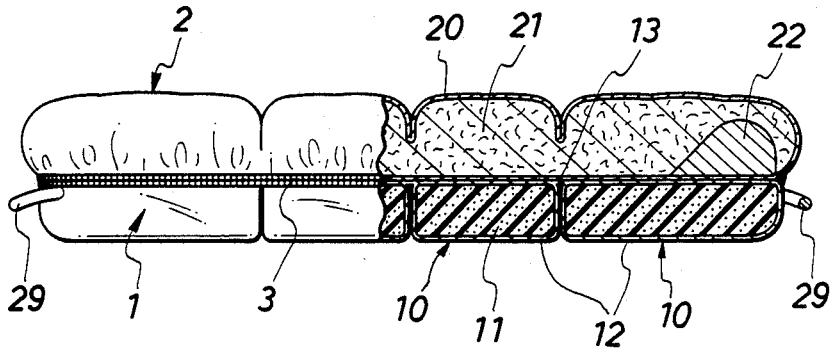
FIG. 7 is a side view taken on the line of IV—IV of FIG. 6 with a portion cut away to show the internal structure.

Referring to FIGS. 1 to 8, there is shown a mat according to the present invention. The mat comprises a cushion base 1, and a cushion member 2 detachably connected to the cushion base 1 and covering its upper surface. The mat has a shape and dimension suitable for supporting the whole body of the user, and is adapted for use on the floor. In the embodiment shown, the mat is somewhat oval with both ends formed as semi-circularly.

The cushion base 1 is assembled by a plurality of block plates 10 which will have a predetermined shape and dimension of the mat when connected together. Each block plate 10 comprises a continuous foamed urethane resin plate 11 having a required thickness and preferably having air permeability characteristic of "open-cell" type foam, a thick cloth 12 enveloping the plate 11, and bendable connection members 13 connecting the upper periphery of the adjacent block plates 10 and permitting relative bend at the upper periphery. The block plates 10 are divided and connected by a longitudinal fold line 14 and a plurality of lateral fold line 15 across the fold line 14. The cushion base 1 can be folded upward along the longitudinal and lateral fold lines 14 and 15. The block plates 10 may not be connected by the connection members 13 but sewed together at the upper periphery.

The cushion member 2 includes a cloth, bag-like wrapper 20 of such a shape and dimension that can cover the upper surface of the cushion base 1, and a synthetic cotton material 21, such as polyester cotton, is filled in the wrapper 20 so as to provide a predetermined softness and thickness. The cushion member 2 cooperates with the cushion base 1 to provide the user with a comfortable cushion.

Figure 8:
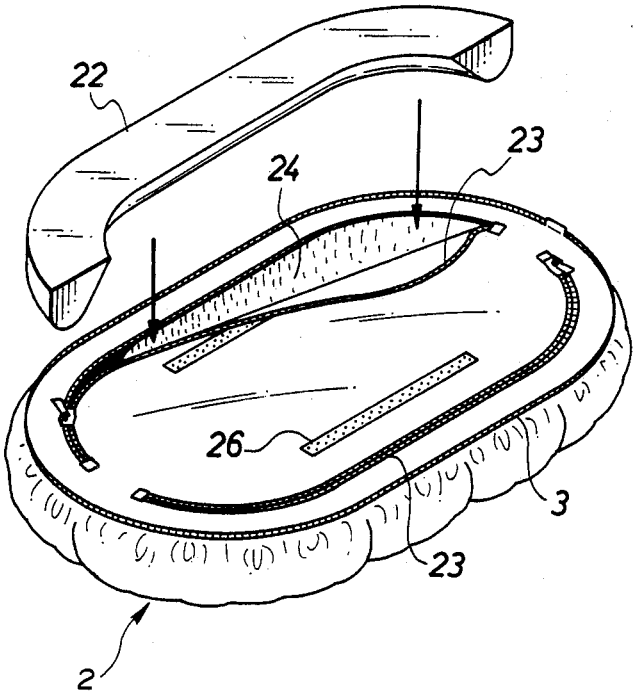
FIG. 8 is a perspective view of the cushion member as seen from the bottom showing the condition of inserting a core material therein.

Preferably, core materials 22 are inserted in the cushion member 2 on the longitudinal side edges thereof so as to provide desired rigid swell and a stable support for the user. FIG. 8 shows the condition of inserting the core material 22. Along the opposite sides of the lower surface of the cushion member 2, there are openings 24, each openable by an opening means 23 such as a fastener. The core materials 22 are inserted from the opening 24 and then the openings are closed.

The upper surface of the cushion base 1 and the lower surface of the cushion member 2 are formed flat so that the cushion member 2 can be stably placed on and supported by the cushion base 1. The cushion base 1 and the cushion member 2 are detachably connected and united in one body by connection means 3 such as a fastener surrounding the outer periphery thereof. Further, it is preferable to make the cushion base 1 and the cushion member 2 detachable from each other and prevent the relative slippage in the central portion thereof by applying thereat a velvet type fastener, the combination of a pile-like sheet 25 and a sheet 26 made of thicker yarn and having hooks.

It is to be noted that this type of connection means may be used to join the outer periphery.

The cushion member 2 is formed with a longitudinal and plural lateral fold lines 27 and 28 in alignment with the fold lines 14 and 15 of the cushion base 1, respectively, so as to allow the cushion member 2 to transform in correspondence to the fold along the lines 14 and 15 of the cushion base 1. The lines 27 and 28 are preferably formed in stitches. Handles 29 are attached to the cushion base 1 at the opposite ends in the longitudinal direction, so as to facilitate transportation of the mat.

Figure 9:
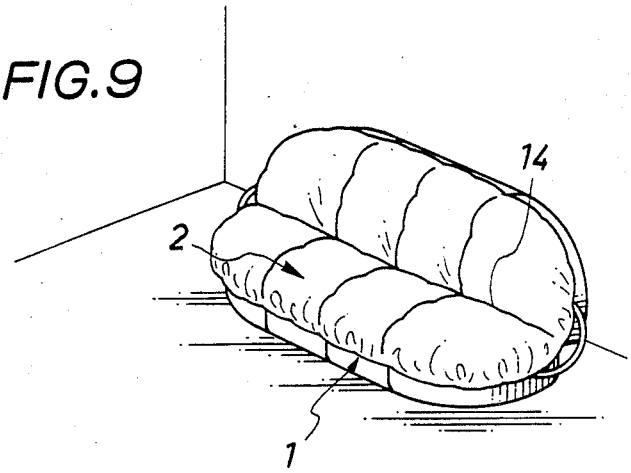
FIGS. 9 through 11 are perspective views of the mat showing various applications.
Figure 10:
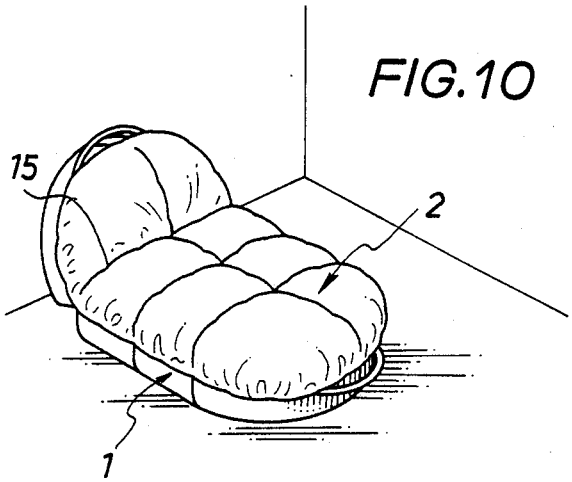
Figure 11:
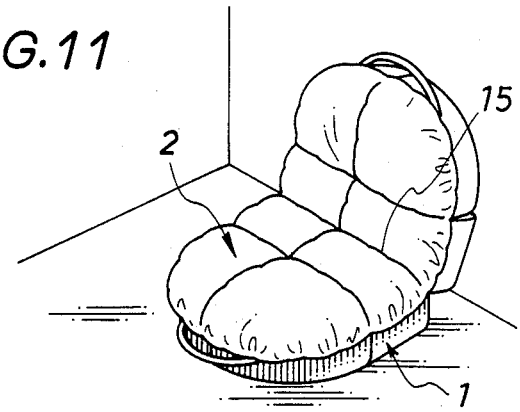

The above-constructed mat is foldable upward along the longitudinal fold line 14 and also along the lateral fold line 15. The mat can have an extremely stable folding posture because the lower surfaces of the fold lines split and open wide when folded. Therefore, the mat can be used as a sofa if it is folded longitudinally along the fold line 14 and rested against the wall of a room, as shown in FIG. 9. On the other hand, the mat can be used as a lounge suitable for a nap if folded along the lateral fold line on the extreme end and reclined on the wall. Further, the mat is also available as an armchair if folded along the middle lateral fold line 15 and leaned against the wall, as shown in FIG. 11, with the core materials 22 functioning as a posture stabilizer and also as arms. If the mat is laid flat on the floor, it can be used as a bed like a futon (Japanese bed). In this case, the user can sleep in a stable posture with a quilt cushion 30 laid over the mat.

Although the mat according to the present invention is a bulky thick product, the mat has a longitudinal and plural lateral fold lines opening wide at the lower surfaces thereof and, if folded along the fold line and rested against the wall or so on, it can maintain its folded condition for ever unlike the conventional one. Thus, the mat of the present invention has abundant characteristics as an interior furniture and is sufficient for daily use without purchasing a suite of furniture such as sofa, lounge, armchair, etc. and also without requiring attachments for supporting arms, back, and legs. Therefore, the present invention is economical and space-saving and has a good merit not only for general users but also for manufacturers and distributors.

What is claimed is:

1. A foldable and transformable thick mat comprising:

a cushion base including a plurality of juxtaposed block segments each having a predetermined cushion property and thickness, said block segments being connected together at adjacent upper surfaces thereof, and movably foldable about a centrally disposed longitudinal fold line and a plurality of parallel transverse fold lines intersecting said longitudinal fold line, said fold lines being formed by slots which facilitate separation of the segments when folded;

a cushion member covering the upper surfaces of the cushion base segments and having a longitudinal fold line and plural transverse fold lines positionally corresponding to the fold lines of the cushion base when the cushion member is placed on the cushion base; and connecting means for detachably connecting the cushion base and the cushion member without inhibiting transformation of the mat into various shapes by folding the cushion base and cushion member along the fold lines.

2. A mat as claimed in claim 1, wherein the cushion member includes core materials insertable into the cushion member at opposite side edges thereof and forming a rigid swell thereat.

3. A mat as claimed in claim 1, wherein the block segments of the cushion base each comprise a foamed body made of open-cell foam material.

4. A mat as claimed in claim 1, wherein the connection means comprises complementary fastener means disposed between the cushion member and the cushion base.

* * * * *